US010563912B1

(12) United States Patent
Kumar et al.

(10) Patent No.: US 10,563,912 B1
(45) Date of Patent: Feb. 18, 2020

(54) MECHANISM TO REDUCE LATERAL PLAY IN CRISPER PAN/FREEZER DRAWER

(71) Applicant: WHIRLPOOL CORPORATION, Benton Harbor, MI (US)

(72) Inventors: Shrawan Kumar, St. Joseph, MI (US); Vinay M. Patil, Pune (IN); Pranav, St. Joseph, MI (US); Lokendra Kumar, Mathura (IN); Amit Prakash Powade, Bengaluru (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/176,583

(22) Filed: Oct. 31, 2018

(51) Int. Cl.
*F25D 25/02* (2006.01)
*A47B 88/437* (2017.01)
*A47B 88/423* (2017.01)

(52) U.S. Cl.
CPC ..... *F25D 25/025* (2013.01); *A47B 88/423* (2017.01); *A47B 88/437* (2017.01); *A47B 2210/175* (2013.01)

(58) Field of Classification Search
CPC ..... F25D 25/025; A47B 88/437; A47B 2210/175
USPC ..... 312/331
See application file for complete search history.

(56) References Cited

U.S. PATENT DOCUMENTS 4,173,380 A 11/1979 Diipree
4,834,557 A * 5/1989 Dreinhoff ..... B60B 33/0028 384/54
5,040,856 A * 8/1991 Wilkins ..... F25D 25/025 312/334.21
5,484,198 A 1/1996 Pilliod
7,712,852 B2 * 5/2010 Choi ..... F25D 25/025 312/301
8,403,437 B2 * 3/2013 Bergmann ..... F25D 25/021 312/404
8,607,588 B2 * 12/2013 Oh ..... F25D 25/025 62/465
8,668,286 B2 * 3/2014 Gasser ..... A47B 88/447 312/331
9,513,047 B2 * 12/2016 Chellappan ..... F25D 23/04
9,976,797 B2 5/2018 Lee et al.
2008/0202145 A1 * 8/2008 Lim ..... F25D 25/025 62/382

(Continued)

FOREIGN PATENT DOCUMENTS

CA 1293764 C 12/1991
EP 2609384 B1 6/2015

*Primary Examiner* — Daniel J Rohrhoff
(74) *Attorney, Agent, or Firm* — Price Heneveld LLP

(57) ABSTRACT

A refrigerator drawer assembly includes a drawer body, a first wheel mounted on a first side of the drawer body, and a second wheel mounted on a second side of the drawer body. The first and second wheels have respective first and second widths. The assembly also includes a first guide body including a first track defining a closed side and an open side. The first guide body defines a lip surrounding at least a portion of the open side and spaced from the closed side at a first distance generally equal to the first width. The first wheel is at least partially received between the closed side and the lip. The assembly further includes a second guide body has a second track defining closed side and an open side. The open side is spaced from the closed side at a second distance greater than the second width.

19 Claims, 11 Drawing Sheets

(56) References Cited

U.S. PATENT DOCUMENTS

| | | | | |
|---|---|---|---|---|
| 2017/0198963 | A1* | 7/2017 | Hanson | F25D 25/025 |
| 2019/0041123 | A1* | 2/2019 | Lee | F25D 23/067 |

* cited by examiner

MECHANISM TO REDUCE LATERAL PLAY IN CRISPER PAN/FREEZER DRAWER

BACKGROUND

The present device generally relates to assemblies for slidably mounting components, including drawers, trays, or the like within an interior of a refrigerator. More particularly, the present assemblies include features for improving the lateral positioning of the component.

Refrigerators may include a variety of storage components or the like therein. Such components can include bins, trays, pans, or the like and can be disposed within an interior of both a fresh food compartment and a freezer compartment. Such components can typically be associated with various tracks or guides in an assembly thereof, such tracks and guides being mounted with an interior liner of the relevant interior portion. The number of tolerances involved in the relative positioning of the tracks, guides or the like with respect to each other and with respect to the corresponding portions of the sliding component, which may include additional guides, flanges, wheels and the like, may make a close-fitting relationship of the sliding component with the associated guide components generally impractical. This difficulty often results in the mating components in such an assembly being loose fitting to accommodate the various tolerances and mismatching thermal expansion of components. As a result, the sliding components can often be misaligned with respect to each other and additional internal components and can yaw or otherwise exhibit lateral play during sliding movement, resulting in a diminished customer experience and perception of value. Accordingly, further advances may be desired.

SUMMARY

In at least one aspect, a refrigerator drawer assembly includes a drawer body, a first wheel mounted on a first side of the drawer body, and a second wheel mounted on an opposite second side of the drawer body. The first and second wheels have respective first and second widths. The assembly also includes a first guide body including a first track defining a closed side and an open side. The first guide body defines a lip surrounding at least a portion of the open side. The lip is spaced from the closed side at a first distance generally equal to the first width, and the first wheel is at least partially received between the closed side and the lip. The assembly further includes a second guide body has a second track defining closed side and an open side. The open side is spaced from the closed side at a second distance greater than the second width.

In at least another aspect, a refrigerator drawer assembly includes a drawer body having a first side surface and a first flange extending laterally outwardly from the first side surface and defining a first support surface generally normal to the first side surface and a first guide body including a first support wheel operably mounted on the first guide body. A first resiliently flexible cantilever arm extends from a portion of the first guide body, and a first guide wheel is mounted on the cantilever arm. The first support surface of the drawer body is moveably supported with respect to the first guide body on the first support wheel, and the first guide wheel forcibly engages the drawer body along the first side surface.

In at least another aspect, a refrigerator drawer assembly includes a drawer body having a first side surface with a first flange extending laterally outwardly from the first side surface and defining a first support surface at a first oblique angle with respect to the first side surface and a second side surface with a second flange extending laterally outwardly from the second side surface and defining a second support surface at a second oblique angle with respect to the second side surface. The assembly further includes a first guide body having a first support wheel operably mounted on the first guide body. The first support surface of the drawer body is moveably supported with respect to the first guide body on the first support wheel along a contact area of the first support wheel that extends along the first oblique angle. The assembly further includes a second guide body having a second support wheel operably mounted on the second guide body. The second support surface of the drawer body is moveably supported with respect to the second guide body on the second support wheel along a contact area of the second support wheel that extends along the second oblique angle.

These and other features, advantages, and objects of the present device will be further understood and appreciated by those skilled in the art upon studying the following specification, claims, and appended drawings.

DETAILED DESCRIPTION OF EMBODIMENTS

Figure 1:
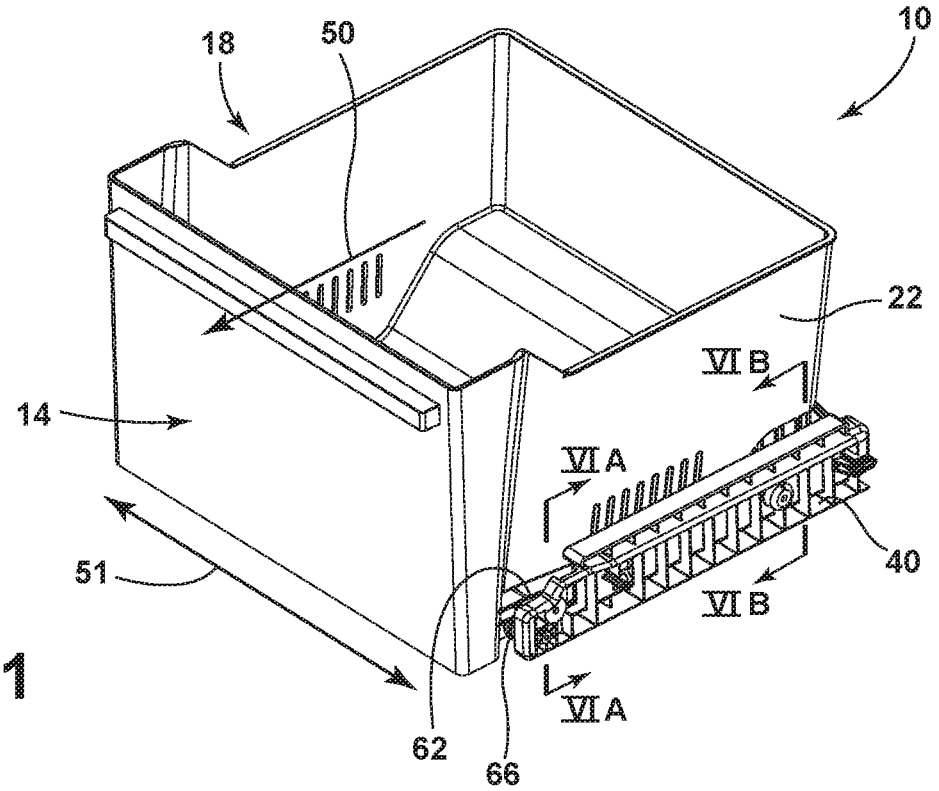
FIG. 1 is a front perspective view of a refrigerator drawer assembly.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
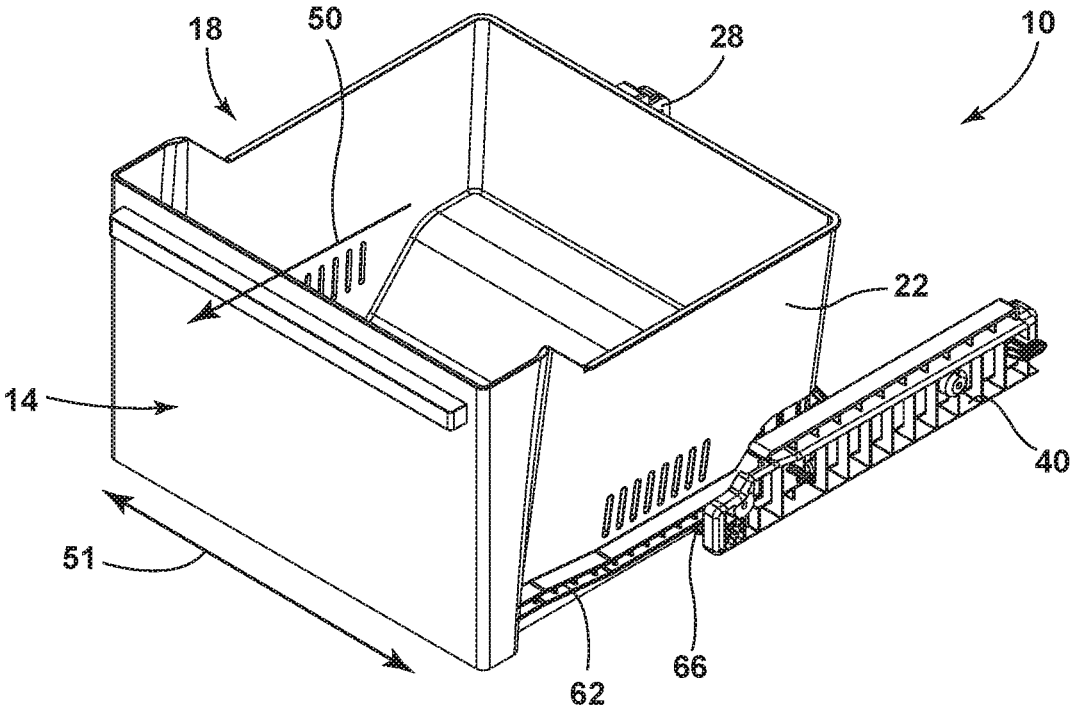
FIG. 2 is a front perspective view of the refrigerator drawer assembly with a drawer body thereof in an extended position relative to a pair of guide bodies.
Figure 3:
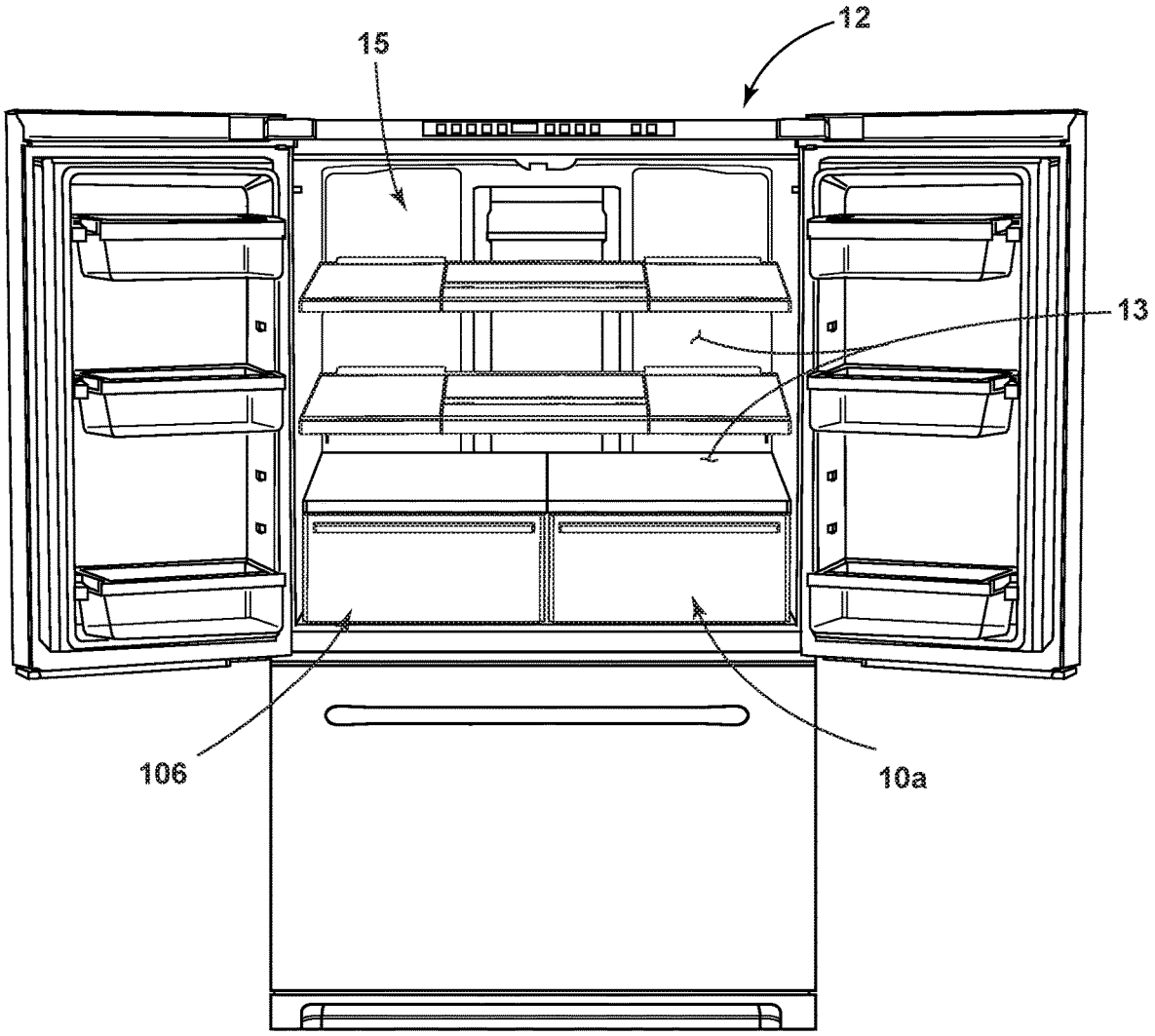
FIG. 3 is a front-perspective view of a refrigerator interior including two drawer assemblies according to FIG. 1.

Referring to FIGS. 1-6B, reference numeral 10 generally designates a drawer assembly useable in at least one example in a refrigerator 12 (FIG. 3). As shown, assembly 10 includes a drawer body 14, a first wheel 16 mounted on a first side 18 of the drawer body 14, and a second wheel 20 mounted on an opposite second side 22 of the drawer body 14. The first and second wheels 16,20 have respective first and second widths 24 and 26. The assembly 10 also includes a first guide body 28 having a first track 30 defining a closed side 32 and an open side 34. The first guide body 28 defines a lip 36 surrounding at least a portion of the open side 34. The lip 36 is spaced from the closed side 32 at a first distance 38 generally equal to the first width 24 of the first wheel 24, and the first wheel 16 is at least partially received between the closed side 32 and the lip 34. The assembly 10 further includes a second guide body 40 having a second track 42 defining closed side 44 and an open side 46. The open side 46 is spaced from the closed side 32 at a second distance 48 greater than the second width 26 of the second wheel 20.

As shown in FIGS. 1 and 2, the first and second tracks 30,42 of the respective first and second guide bodies 28,40 extend in a sliding direction 50 of the drawer body 14 with respect to the first and second guide bodies 28,40. In this manner, the first and second wheels 16,20 are operably engaged with the first and second tracks 30,42, respectively, to facilitate movement of the drawer body 14 in the sliding direction 50. The above-described configuration of the first and second tracks 30,42, along with the first and second wheels 16,20, particularly with respect to the widths 24,26 of the wheels 16,20, can provide an improved ability of assembly 10 to maintain drawer body 14 in an aligned position with respect to sliding direction 50 during movement of drawer body 14 in the sliding direction with respect to tracks 30,42 and to maintain an intended position of drawer body 14 with respect to guide bodies 28,40 in lateral direction 51. As in other types of refrigerator drawer assemblies, various guide bodies or other structures are coupled with the interior 15 of the associated refrigerator 12. In this manner, the improved positioning of drawer body 14 with respect to guide bodies 28,40 can result in the present drawer bodies 14 being more reliably and/or consistently positioned within the interior 15 of the refrigerator 12 (FIG. 2), including with respect to adjacent portions of the interior, other interior features of refrigerator 12 (e.g., shelves or the like) or other adjacent drawer bodies 14 of additional drawer assemblies 10. In particular, the number of tolerances involved in the relative positioning of the guide bodies 28,40 with respect to each other and with respect to the corresponding first and second wheels 16,20 may make a close-fitting relationship of both the first and second wheels 16,20 with the respective tracks 30,42 generally impractical.

Figure 6A:
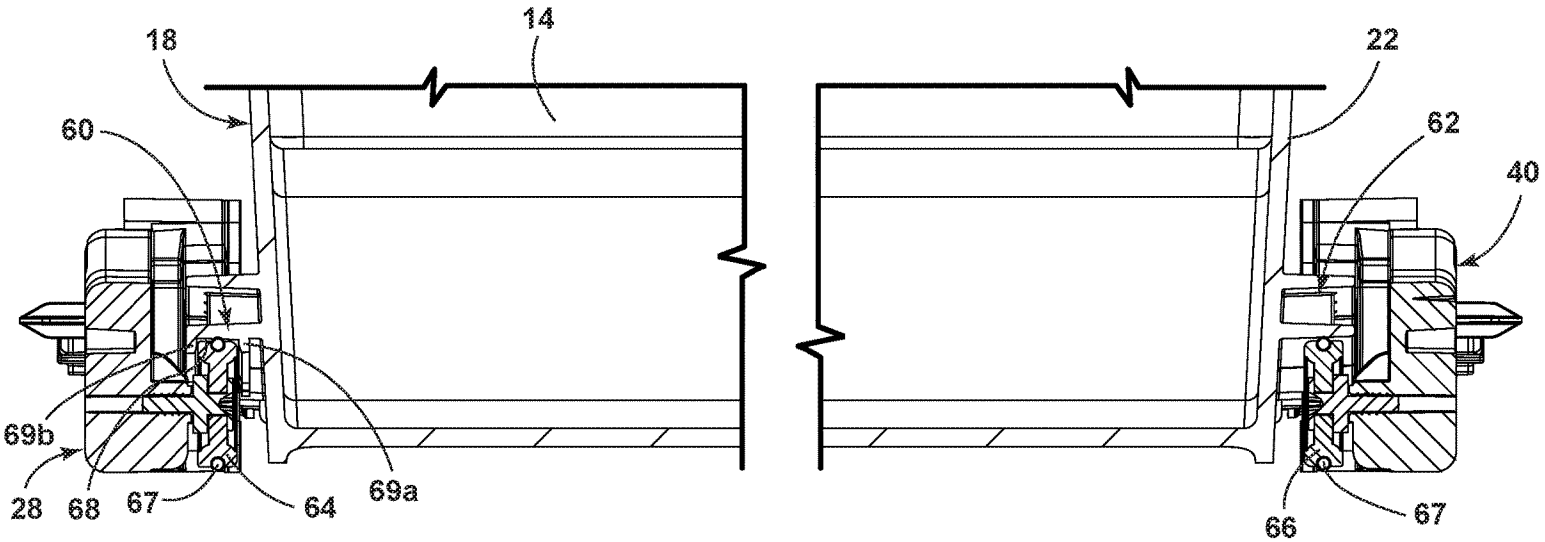
FIGS. 6A and 6B are respective cross-sectional views of portions of the refrigerator drawer assembly taken along lines VI(A)-VI(A) and VI(B)-VI(B) in FIG. 1.
Figure 6B:
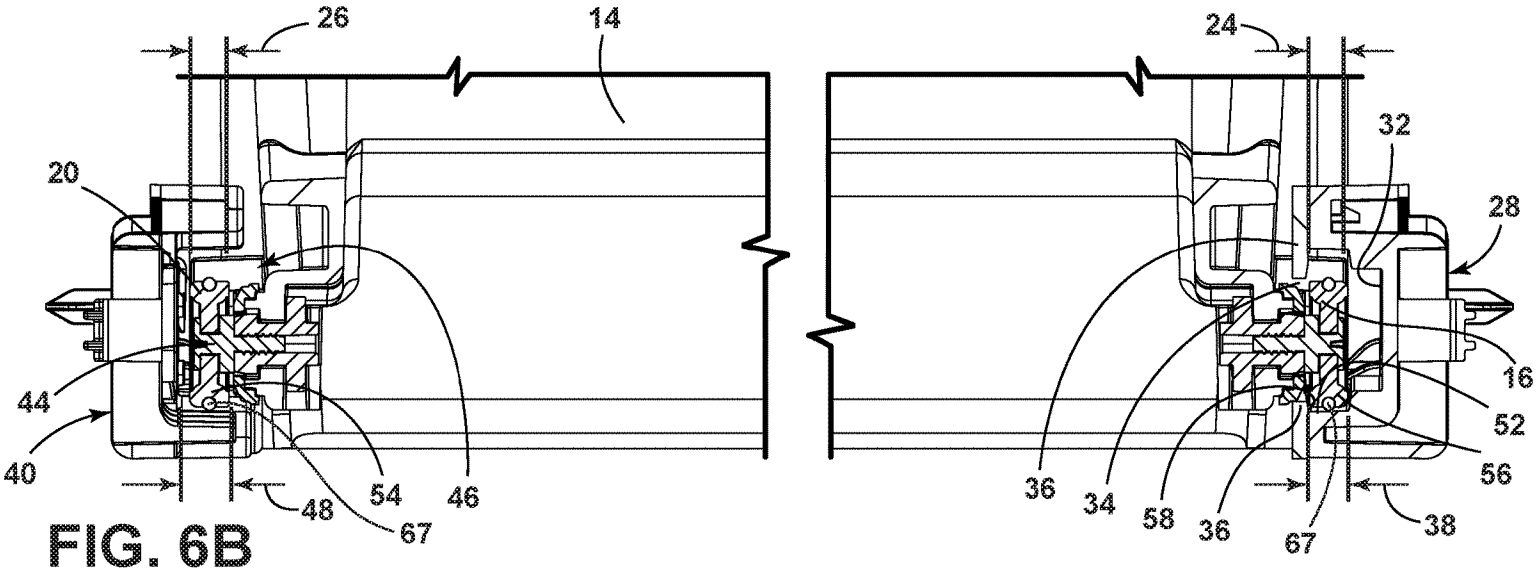

In the present assembly 10, the difference in widths 38,48 of the first and second tracks 30,42, including relative to the corresponding widths 24,26 of the first and second wheels 16,20 can account for the tolerances of assembly 10, including with respect to the portions of refrigerator 12 to which guide bodies 28,40 are coupled, while generally maintaining a desired position of drawer body 14 along the sliding direction 50 both during movement of drawer body 14 and when drawer body 14 is in the closed position. As shown in FIG. 6B, in particular, the first and second wheels 16,20 are mounted with the drawer body 14 through the respective open sides 34,46 of the first and second tracks 30,42. In this manner, the respective positions of wheels 16,20 are fixed by their assembly on the respective sides 18,22 of drawer body 14. Similarly, the positions of the tracks 30,42 are fixed by the assembly of guide bodies 28,30 with the liner 13 of refrigerator 12. As shown, the first wheel 16 is positioned within first track 30 so as to be supported on a first supporting surface 52 that extends in the lateral direction 50 through the width 38 of the first track 30 (i.e., between the closed side 32 of the first track 30 and the lip 36. Adjacent the supporting surface 52, the closed side 32 of the first track 30 also defines a first interior surface 56 that extends upwardly (i.e., primarily in a vertical direction) from the first supporting surface 52. Opposite from and facing the first interior surface 56, The lip 36 associated with first guide body 28 defines a second interior surface 56 that similarly extends from the first supporting surface 52, including in an upward direction. In this arrangement, the first wheel 16 is at least partially received between the first interior surface 54 of the closed side 32 and the second interior surface 56 of the lip 36.

As discussed above, the lip 36 is spaced from the closed side 32 at a first distance 38 generally equal to the width 24 of the first wheel 24. More particularly, the first distance 38 defines the width of the first track 30 and can be measured at the intersections of the first interior surface 54 and the second interior surface 56 with the supporting surface 52 from which they extend. It is such a distance 38 that is generally equal to the width 24 of the corresponding portion of the first wheel 16, which is generally the outer profile of the wheel 16 and/or the closest portion of the first wheel 16 to the supporting surface 52. In an example, the first distance 38 being generally equal to the width 24 of first wheel 24 can establish a close, operable fit of wheel 16 within the space between the facing interior surfaces 54 and 56, with a small variation therebetween by way of the first distance 38 being slightly greater than width 24 to allow for wheel 16 to rotate with respect to track 30 during movement of drawer body 14 in the sliding direction 50, including within a range of tolerances for both guide body 28 and wheel 16 (which may also take into account the effects of the temperature within refrigerator 12 on the respective sizes of the components, as well as potential changes to the sizes of the components due to fluctuations in the temperature).

In an aspect, a baseline for distance 38 between interior surfaces 54,56 can be equal to the width 24 of wheel 16, with an absolute or percentage increase to distance 38 being provided to ensure that tolerances and/or thermal expansion does not result in distance 38 being less than width 24. Such an increase, however, can be kept at a minimum acceptable level for reliable operation such that the close fitting of wheel 16 within first track 30 can maintain a desired position of drawer body 14 with respect to guide body 28 and, accordingly within refrigerator 12. Further, the fitting of wheel 16 within track 30 (including the height of lip 36 with respect to the diameter of wheel 16) can help maintain a longitudinal axis L of the drawer body 14 along or close to the sliding direction 50 during operation of drawer assembly 10 (i.e. within about 3°-6°). In an example, the distance 38 can be between about 0.5 mm and 1 mm or, alternatively, between about 1% and 2% greater than width 24 of wheel 16 while still being considered generally equal thereto.

As further shown in FIG. 6B, the second track 42 includes a second supporting surface 54 that extends between the closed side 44 and the open side 46 of the second track 42 that supports second wheel 20 when the drawer body 14 is in the closed position (FIGS. 1 and 3) and through at least a portion of the movement of drawer body into the open position (FIG. 2). Notably, the second supporting surface 54 transitions directly to the open side 46 of the track 42 such that no lip or other structure is present to contact or restrain the position of second wheel 20. As discussed above, the distance 48 between the closed side 44 and the open side 46 of the second track 42 (such distance 48 defining the width of the support surface 54) is greater than the comparative distance 38 between the closed side 34 and the lip 36 of the first track 30. In this manner, the total tolerance stack-up for the distance between wheels 16,20 and tracks 30,42 can be taken up by a variance in the position of wheel 20 within track 42 provided by the additional width thereof. Further, because track 42 lacks the lip 36 of track 30, it may be possible for wheel 20 to partially extend through open side 46 of track 42, while still maintaining the desired operation of assembly 10. In one example, the distance 48 between closed side 44 and open side 46 may be greater than the distance 38 between closed side 32 and lip 36 by between about 120 percent and 200 percent. In a particular embodiment, the widths 24,26 of the wheels 16,20 can be the same (with accounting for manufacturing tolerances and the like). This and other similar configurations can permit the above-described close fitting of wheel 16 in track 30 and the resulting improvements in lateral positioning and angle reduction of drawer body 14, without the need to reduce the tolerances of the components and features outside of the distance 38 between closed side 32 and lip 36.

As shown in FIG. 2, in one example, drawer body 14 can be configured for use as a crisper drawer or other similar feature within a fresh food compartment of refrigerator 12. In such an example, the present assembly 10 may generally extend across half of the interior 13 of refrigerator 12 in lateral direction 51, as indicated by assembly 10*a* in FIG. 3. Accordingly, an additional assembly 10*b* according to a similar construction can also be included within refrigerator 12. In such an example, the assemblies 10*a* and 10*b* can be mirror-images of each other such that the guide bodies 28 with the close-fitting track 30 are positioned adjacent each other (i.e. closest the other assembly 10*b* and 10*a*). In this manner, the above-described positioning of drawer bodies 14 by way of the fit of wheel 16 within track 30 can maintain the drawer bodies 14 of the assemblies 10*a*,10*b* in similar positions where the two drawer bodies 14 are adjacent to each other (making any differences more noticeable). Accordingly, any variations in the positioning of particular elements or features of the assemblies 10*a*,10*b* would be present at the laterally-outward portions of the assemblies 10*a*,10*b*, where such variations are less readily compared and are, therefore, less visually distinguishable. Other similar arrangements are possible for additional or alternative sliding structures or features within refrigerator 12, including trays, freezer bins, or the like, wherein different drawer body types 14 can be used in connection with the other features described herein, including the particular arrangements of the tacks 30,42 and the corresponding wheels 16,20.

Figure 4:
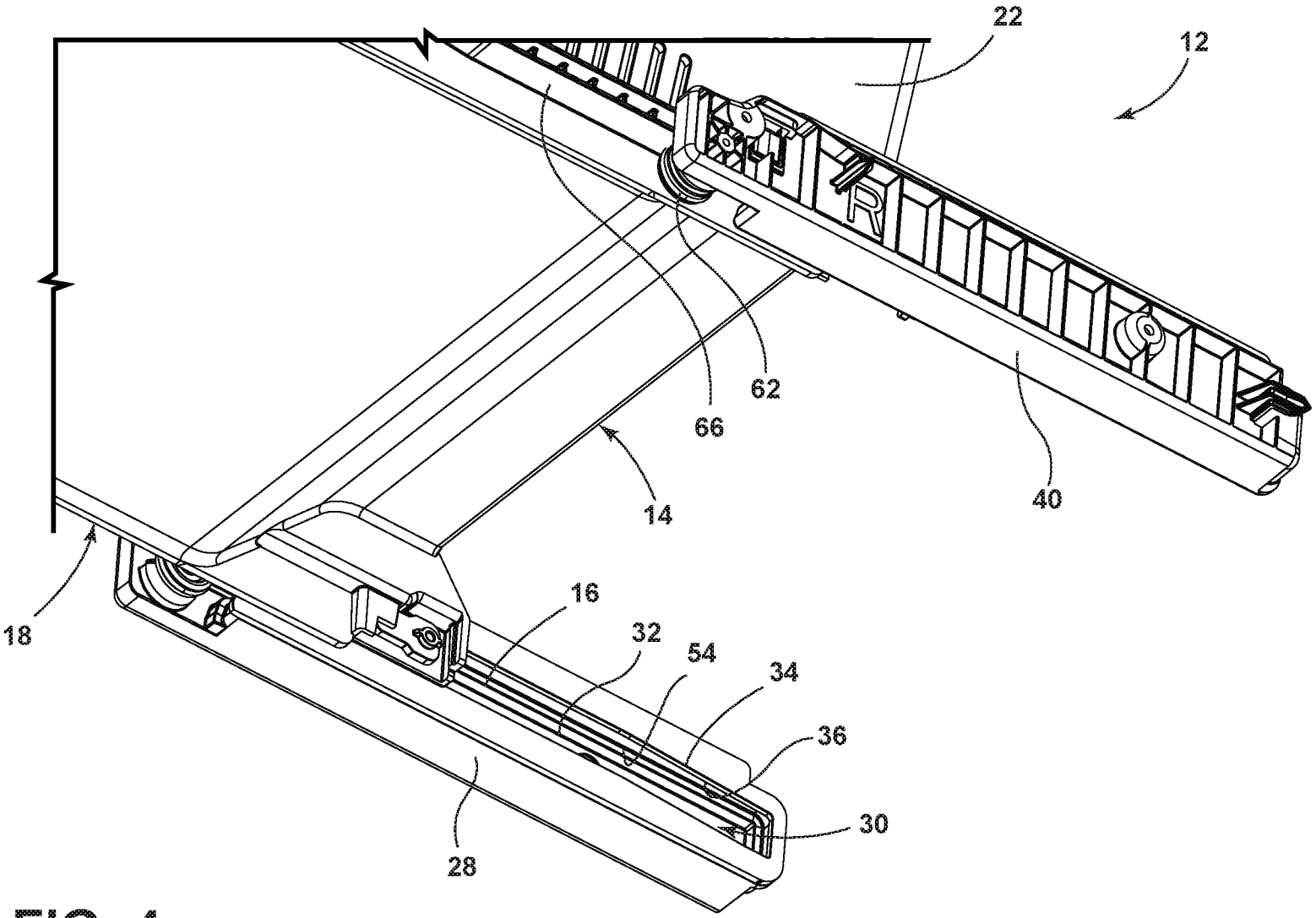
FIG. 4 is a bottom-perspective detail view of the refrigerator drawer assembly with the drawer body thereof in an extended position relative to the pair of guide bodies.
Figure 5A:
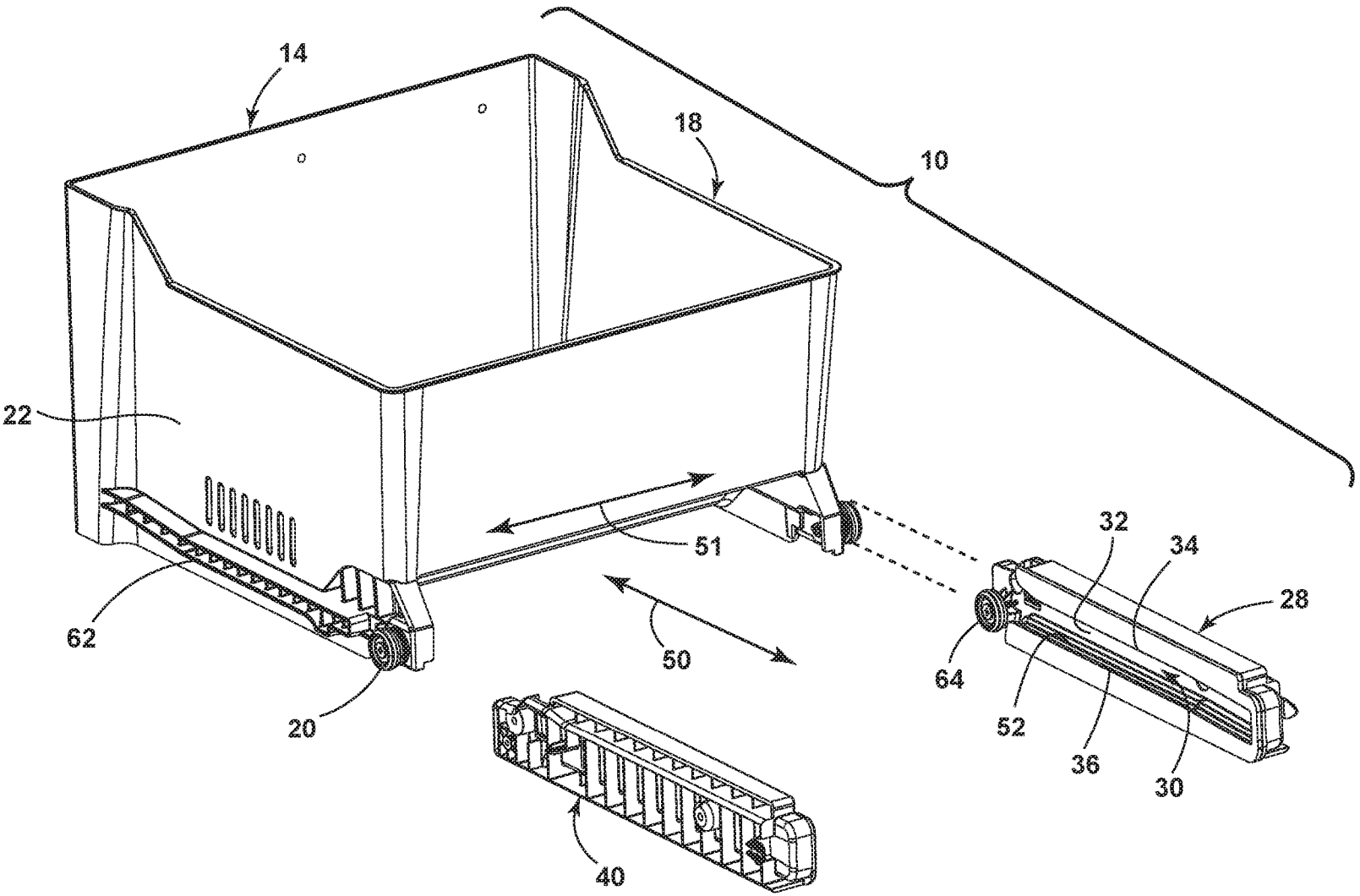
FIGS. 5A and 5B are respective back-perspective exploded views of the refrigerator drawer assembly.

As shown in FIGS. 4 and 5A, the drawer body 14 may further define first and second flanges 60,62 extending along at least respective portions of the first and second sides 18,22 of the drawer body 14. In such an arrangement, the assembly 10 can further include third and fourth wheels 64 and 66 operably mounted on the first and second guide bodies 28 and 40, respectively with the third and fourth wheels 64,66 operably supporting the drawer body 14 on the first and second flanges 60,62, respectively, (as shown in FIG. 6A) including during movement of the drawer body 14 from the closed position to the open position. In such an arrangement, third and fourth wheels 64,66 can maintain the vertical positioning of the front end of the drawer body 14 when in or near the closed position and can provide a counteracting force to the engagement of the first and second wheels 16,20 with the first and second tracks 30,42 when drawer body 14 is in or near the open position. Under such conditions, the first and second wheels 64,66 may act as a fulcrum with the downward force of the weight of drawer body 14 (and any contents therein) urging first and second wheels 16,20 in an upward direction. In this arrangement, as shown in FIGS. 4 and 5A, the first and second tracks 30,42 can be enclosed around the open sides 34,46 thereof such that the supporting surfaces 52,54 extend around the interior of the tracks 30,42 so as to also be positioned above wheels 16,20. In this manner, when the center of gravity of drawer body 14 (and any contents therein) are moved beyond third and fourth wheels 64,66, the first and second wheels 16,20 can contact the opposite upper portion of the supporting surfaces 52,54 to balance drawer bodies 14 and generally maintain the vertical positions of the front edges thereof.

Figure 5B:
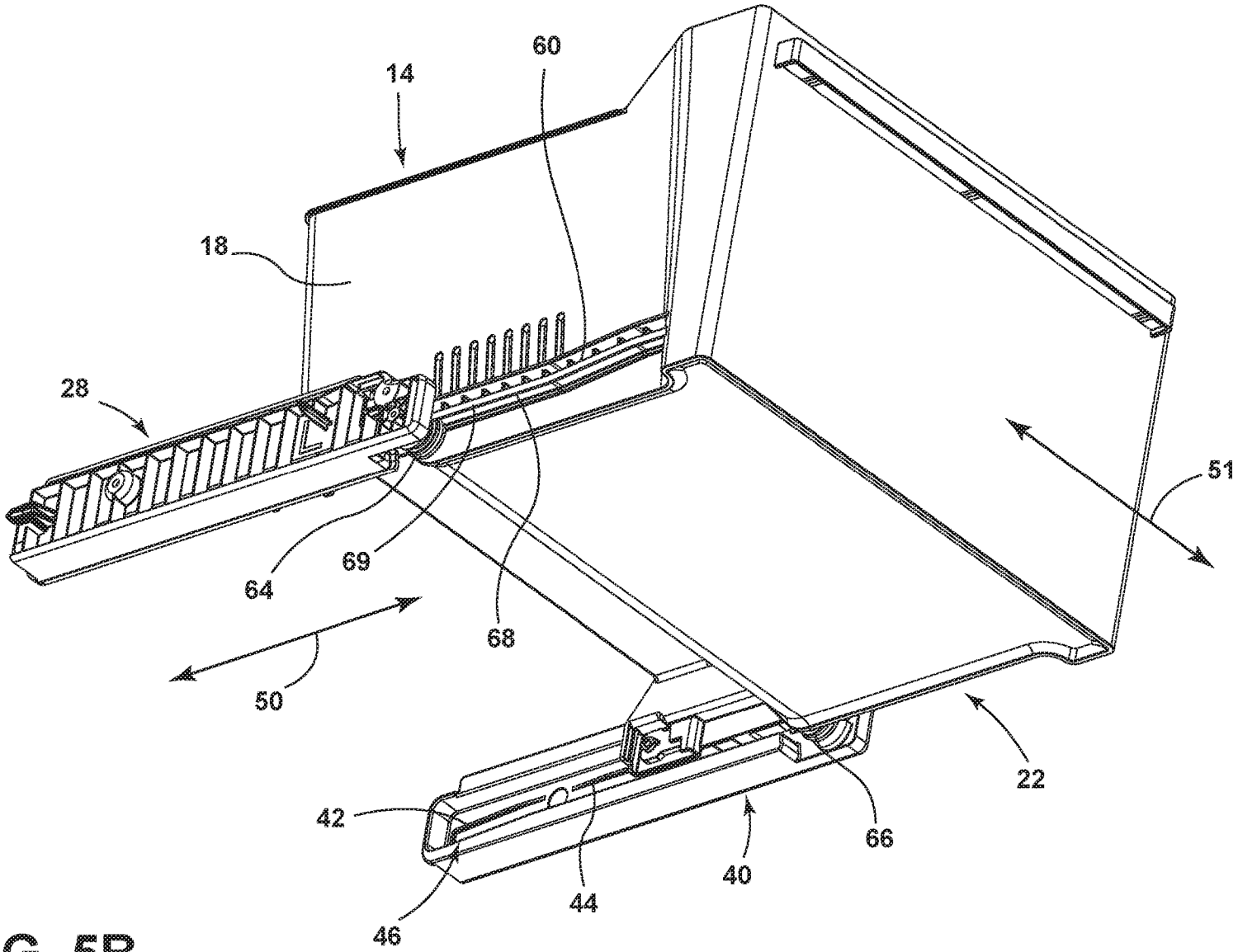

As shown in FIGS. 5B and 6B, the flange 60 on the same side 18 of drawer 14 as first guide body 28 can be configured with spaced apart downwardly-extending lips 69*a*,69*b* thereon that are generally positioned normal (=/− about 5°) from the surface 68 of flange 60 supported by guide wheel 64. As shown, a portion of guide wheel 64 can be captured between lips 69*a*,69*b* in a similar manner to the positioning of wheel 20 between the closed side 32 of track 30 and the facing interior surface 58 of lip 36. In this manner, the spacing between lips 69*a* and 69*b* can be similar to the spacing between the closed side 32 of track 30 and the facing interior surface 58 of lip 36, as discussed above. This arrangement can further facilitate the alignment of drawer body 14 between first guide body 28 and second guide body 40 and can improve the ability of assembly 10 to maintain drawer body 14 generally parallel with the sliding direction 50, including during movement of drawer body 14 in sliding direction 50. As also shown in FIG. 6B, flange 62 on the opposite side 22 can lack such lips and can provide a generally wider surface 70 for supporting of flange 62 on guide wheel 66 to allow for the tolerance stack up to be taken up by the positioning of guide wheel 66 relative to surface 70 in a similar manner to the positioning of second wheel 26 along second track surface 54, as discussed above.

To allow for sliding of drawer body 14 by rotation of wheels 16,20 within tracks 30,42, the upper and lower portions of the supporting surfaces 52,54 can be spaced apart by a distance greater than the diameter of the wheels 16,20 (as shown in FIG. 6B) such that the wheels 16,20 do not simultaneously contact both the upper and lower portions of supporting surfaces 52,54, which could interfere with rotation of wheels 16,20. As further shown in FIGS. 4-6B, the tracks 32,40, flanges 60,62, as well as the respective wheels 16,20,64,66 can further be configured to facilitate operation of drawer assembly 10, including by having portions of tracks 32,34 and flanges 60,62 that respective lower or raise toward the back and front thereof to help guide drawer body 14 into the closed position under the weight thereof. Further, the assembly 10 can be configured such that wheels 16 and 64, as well as wheels 20 and 64, are at least partially aligned when drawer body 14 is in the open position to provide a stop in the movement of drawer body 14 in the sliding direction, which may prevent inadvertent removal of drawer body 14 from assembly 10, while allowing intentional removal by lifting of drawer body 14. Further, wheels 16 can include O-rings 67 assembled therewith or other comparatively soft outer portions to provide a damping effect and to smooth out the rolling of the wheels 16,20,64,66 on the respective surfaces.

Figure 7:
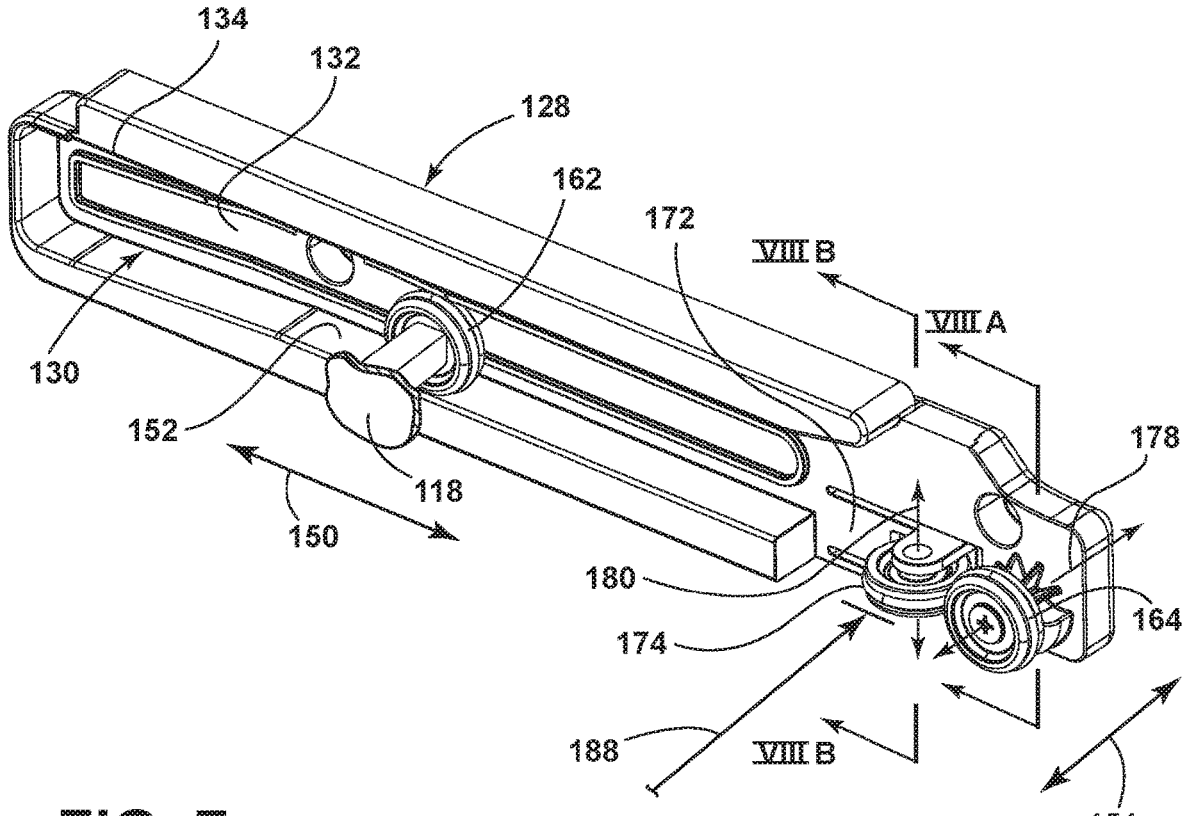
FIG. 7 is a front-perspective view of a guide body useable in connection with a variation of a refrigerator drawer assembly.
Figure 8A:
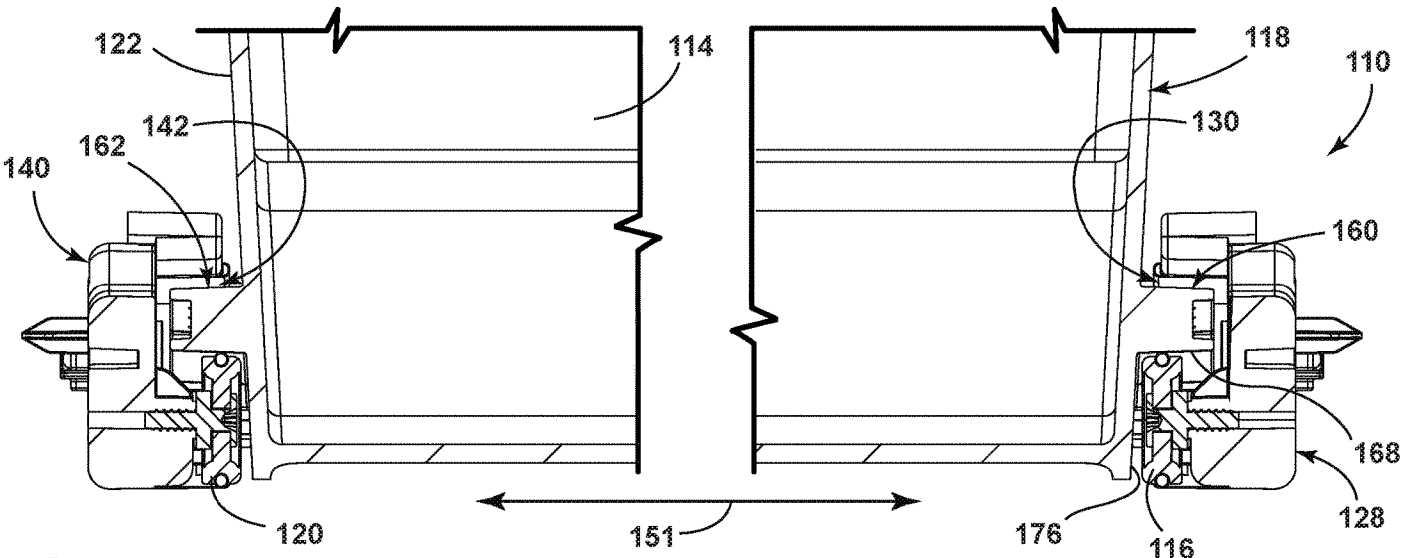
FIGS. 8A and 8B are respective cross-sectional views of portions of the refrigerator drawer assembly taken along lines VIII(A)-VIII(A) and VIII(B)-VIII(B) in FIG. 7.
Figure 8B:
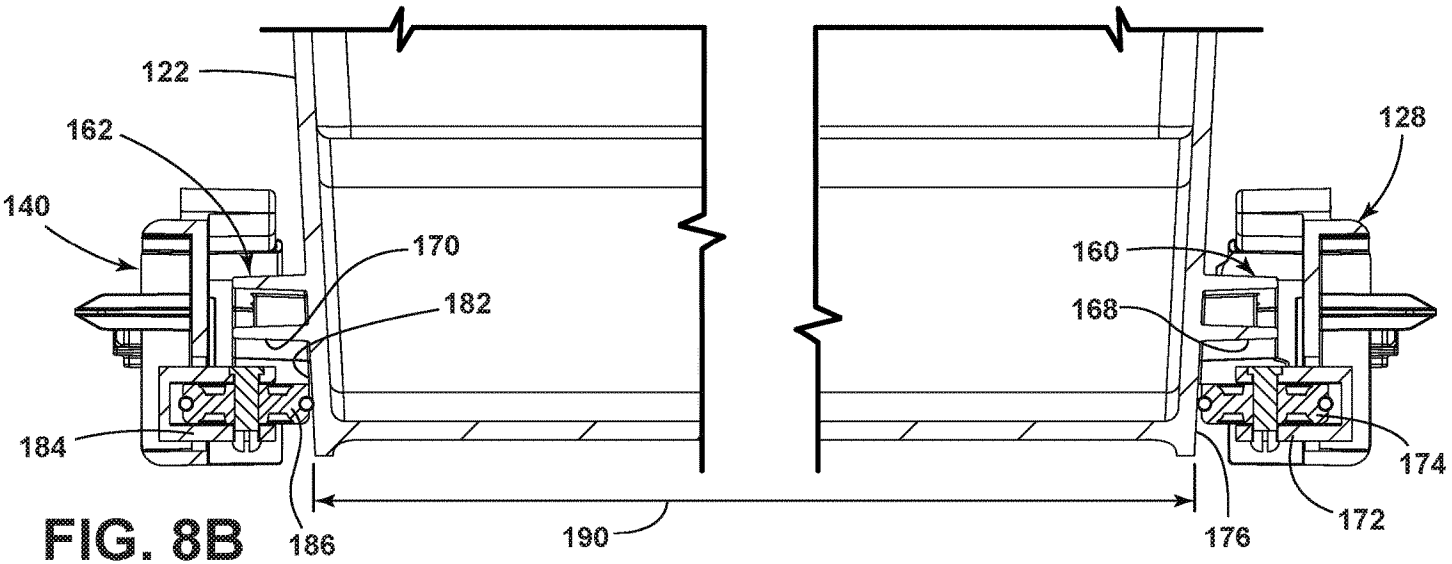
Figure 9:
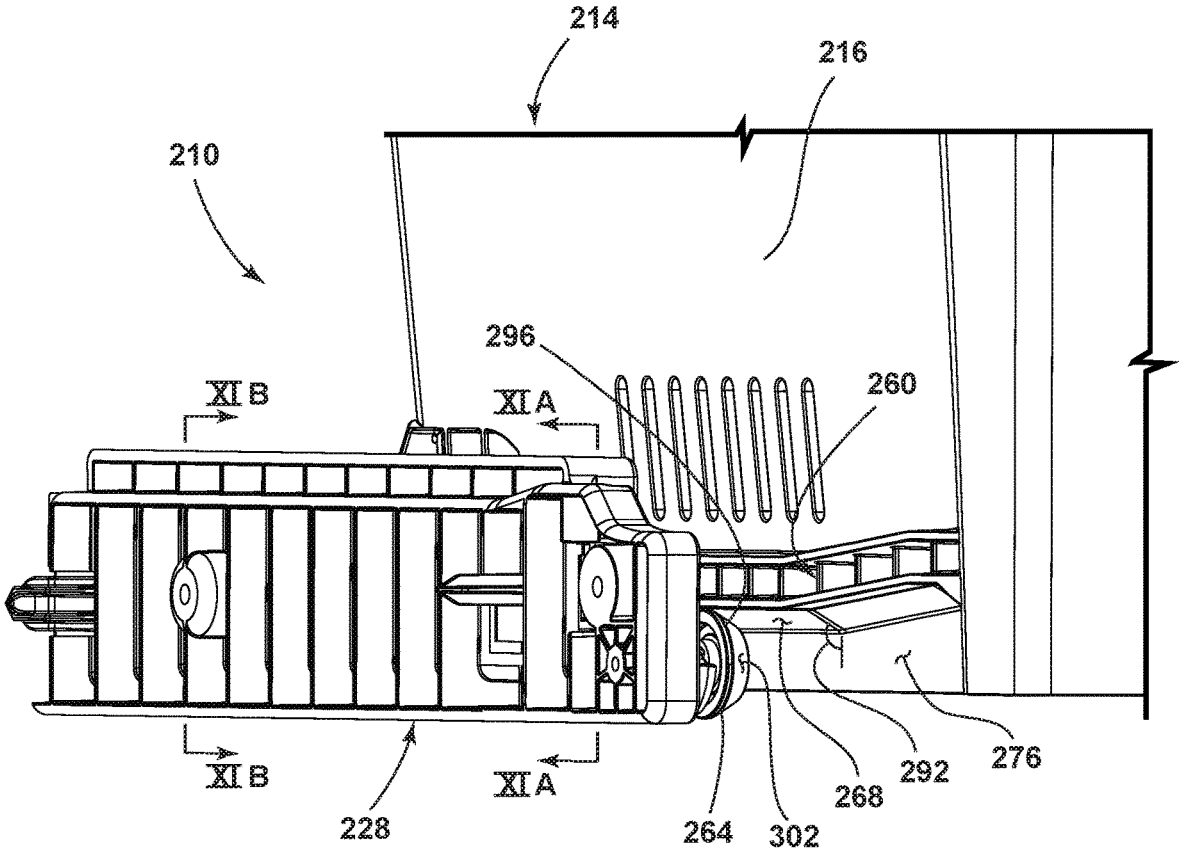
FIG. 9 is a perspective detail view of a portion of a further variation of a refrigerator drawer assembly.

Turning to FIGS. 7, 8A, and 8B, an alternative refrigerator drawer assembly 110 includes a drawer body 114 that can be generally similar to the drawer body 14 discussed above. In the present assembly 110, drawer body 114 has a first side surface 176 (as defined on an outer portion of first side 118) and a first flange 160 extending laterally outwardly from the first side surface 118 and defining a first support surface 168 generally normal to the first side surface 176 (at least in that the first side surface 118 extends primarily vertically and the first support surface 168 extends primarily horizontally). As shown, the assembly 110 also includes a first guide body 128 including a first supporting wheel 164 operably mounted on the first guide body 128. A resiliently flexible cantilever arm 172 extends from a portion of the first guide body 128, and a guide wheel 174 is mounted on the cantilever arm 172. In a similar manner to that which is discussed above, the first support surface 168 of the drawer body 114 is moveably supported with respect to the first guide body 128 on the first supporting wheel 164. In the present assembly 110, the guide wheel 174 forcibly engages the drawer body 114 along the adjacent first side surface 176, as shown in FIG. 8B.

As shown in FIG. 7, the first supporting wheel 164 is rotatably mounted on the first guide body 128 about a first axis 178 that extends generally normal to the side surface 176 and generally parallel with support surface 168. The first guide wheel 174 is similarly rotatably mounted on the first cantilever arm 172 about a second axis 180. With respect to the views shown in FIGS. 8A and 8B, the respective first and second axes 172,180 define respective planes in the sliding direction 150 (i.e. in and out of the page in FIGS. 8A and 8B) that extend generally perpendicular to each other. In this arrangement, both the first and second axis 178 and 180 are transverse to the sliding direction of drawer body 114 such that the supporting wheel 164 and the guide wheel 174 are respectively radially directed toward the support surface 168 and the side surface 176. In this manner, the contact between supporting wheel 164 and support surface 168 on flange 160 provides a supporting force for drawer body 114 on guide body 28 with support wheel 164 rotating to facilitate movement of drawer body 114 generally in the sliding direction 150. Similar to the assembly 10 discussed above, the present drawer body 114 can further include a second side surface 182 on the side 122 of drawer body 114 opposite the first side surface 176 with a second flange 162 extending outwardly from and along a portion of second side 122 in the sliding direction 150. The flange 162 defines second supporting surface 170 generally normal to the second side surface 182. Accordingly, the assembly 110 may further include second guide body 140 that has second guide wheel 166 operably mounted thereon and extending along axis 178. In this arrangement, support surface 170 is similarly supported with respect to the second guide body 140 on guide wheel 166, which further facilitates movement of drawer body 114 in the sliding direction 150.

Still further, both the first and second guide bodies 128, 140 can include respective tracks 130,142 that define respective track surfaces, including track surface 152 (with the opposite track surface being generally a mirror image of track surface 152), extending between respective closed sides 132 and open sides 134 (with the opposite track including similar closed and open sides). The tracks 130,142 can receive respective wheels 116,120 rotatably mounted on the first and second sides 118,122 of drawer body 114. As discussed above, the present track surfaces 152 can extend generally around the open sides 134 of the guide bodies 128,140 such that wheels 116,120 can alternately contact the track surfaces 152 on the upper or lower sides thereof to provide balancing support for drawer body 114 according to the position of drawer body 114 with respect to guide bodies 128,140.

As shown in FIGS. 8A and 8B, both of the supporting surfaces 168,170, as well as the track surfaces 154 are wider than the respective wheels 164,166 and 116,120 to account for tolerances and/or thermal expansion or contraction of the various components of assembly 110, as discussed in greater detail above. In such an arrangement, the forcible contact of guide wheel 174 against the adjacent side surface 176 of drawer body 114 can at least help to maintain a desired position of drawer body 114 in lateral direction 151 with respect to guide bodies 128,140 and, accordingly within refrigerator 12, in a similar manner to that which is discussed above. In particular, because of the positioning of axis 180 and the configuration of cantilever arm 172, which as depicted in FIG. 7, extends within guide body 128 from an adjacent portion thereof to which cantilever arm 172 is integrally formed (for example) generally parallel with the sliding direction 150, the forcible engagement of guide wheel 174 against side surface 176 is in the lateral direction 151 toward drawer body 114. It is the resulting force in lateral direction 151 that can help maintain the desired lateral positioning of drawer body 114 with respect to guide bodies 128 and 140.

To balance against the forcible engagement of first guide wheel 174 against first side surface 176, the second guide body 140 can further include a second resiliently flexible cantilever arm 184 extending from a portion of the second guide body 140 in a manner similar to cantilever arm 172, discussed above and shown in FIG. 7. A second guide wheel 186 is mounted on the second cantilever arm 172 such that the second guide wheel 186 forcibly engages the drawer body along the second side surface 182. As shown in FIG. 8B, the first guide wheel 174 and the second guide wheel 186 forcibly engage the drawer body 114 in opposite directions to reduce lateral movement of the drawer body 114 on the first and second support wheels 164,166, which can further help to maintain drawer body 114 in a generally centered position between guide bodies 128,140.

The both of the guide wheels 174,186 can be sized and positioned on the respective cantilever arms 172,184 such that engagement between the guide wheels 174,186 and the drawer body 114 (on the respective side surfaces 176,182) causes deformation of the cantilevered arms 172,184 out of the natural positions thereof. This deformation causes the engagement of the guide wheels 174,176 with the drawer body 114 along the respective side surfaces 176,182 to be under the inwardly-directed lateral force discussed above. To provide such force, cantilever arms 172,174 can be formed, as discussed, integrally with the respective guide bodies 128,140 and can have a length in the sliding direction 150 a thickness in the lateral direction 151 sufficient to provide a desired force given a range of deformation anticipated based on the tolerances of assembly 110 when in place within the subject refrigerator (such as refrigerator 12, in FIG. 3, for example). In this manner, the guide wheels 174,186 can be positioned and configured on guide bodies 128,140 so as to be positioned relative to each other at a distance 188 that is less than the width 190 of drawer body 114 through an anticipated range of tolerances for assembly 110. Further, the cantilever arms 172,184 can be configured to provide deformation thereof upon assembly of drawer body 114 with guide bodies 128,140 such that drawer body 114 can be accommodated between guide wheels 174,186 through the range of tolerances, without causing the forcible engagement of guide wheels 174,186 with drawer body 114 to impede the desired movement of drawer body 114 in the sliding direction 150.

Turning now to FIGS. 9-11B, a further variation of a refrigerator drawer assembly 210 is shown. The depicted assembly 210 includes a drawer body 214 having a first side surface 276 defined on a first side 218 of drawer body 214 with a first support surface 168 defined on a first flange 260 and extending laterally outwardly from the first side surface 276 and defining a first oblique angle 292 with respect to the first side surface 276. The drawer body 214 also has a second side surface 282 on the opposite second side 222 of drawer body 214 with second flange 262 extending outwardly therefrom and defining a second support surface 270 at a second oblique angle 294 with respect to the second side surface 282. The assembly 210 also includes a first guide body 228 having a first supporting wheel 264 operably mounted on the first guide body 228. The first support surface 268 of the drawer body 214 is moveably supported with respect to the first guide body 228 on the first supporting wheel 264 along a contact area 296 of the first support wheel 264 that extends along the first oblique angle 292. The assembly 210 further includes a second guide body 240 having a second supporting wheel 266 operably mounted on the second guide body 240. The second support surface 270 of the drawer body 214 is moveably supported with respect to the second guide body 240 on the second supporting wheel 266 along a contact area 298 of the second wheel 266 that extends along the second oblique angle 294.

Figure 11A:
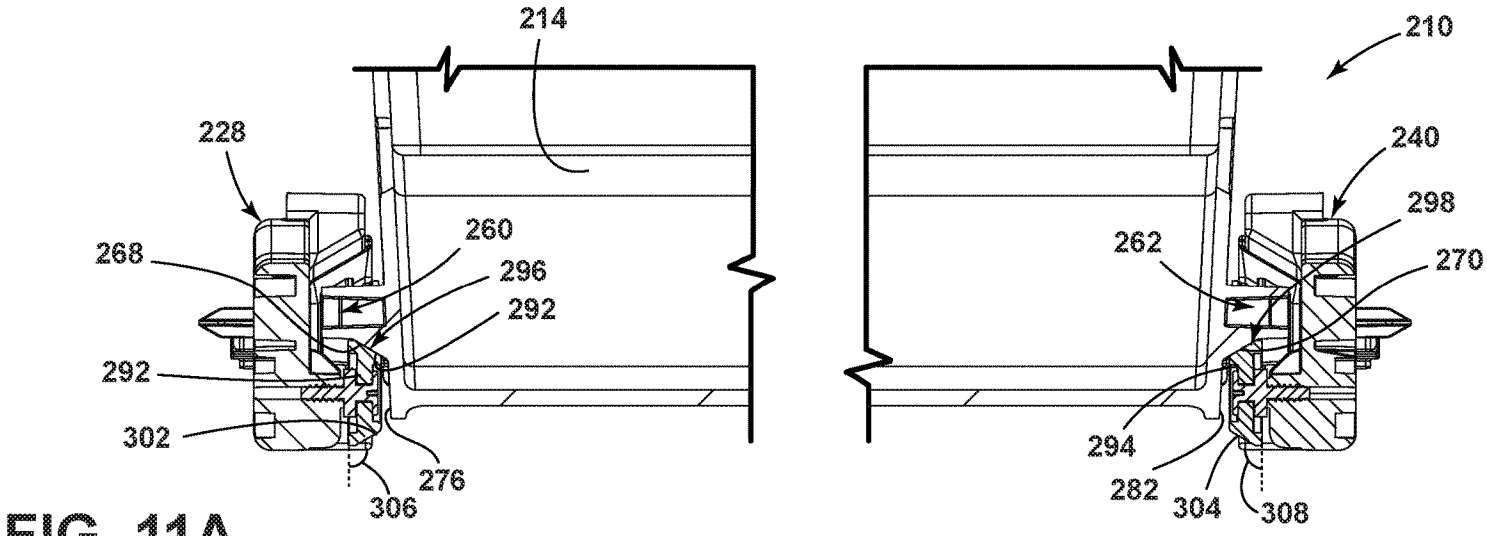
FIGS. 11A and 11B are respective cross-sectional views of portions of the refrigerator drawer assembly taken along lines XI(A)-XI(A) in FIG. 9 and XI(B)-XI(B) in FIG. 10.

As shown in FIG. 11A, the first and second support wheels 264,266 both define truncated conical shapes. In this manner, the respective contact areas 296,298 of the first and second support wheels 264,266 are defined on outer surfaces 302,304 of the respective first and second support wheels 264,266 that are angled with respect to a radial direction of the first and second support wheels 264,266 at respective angles 306,308 equal to the first and second oblique angles 292,294. In the depicted example, the first and second oblique angles 292 and 294 are equal such that the support wheels 264 and 266 can be generally identical, but oppositely mounted. In a variation, the support wheels 264,266 could be generally cylindrically shaped, but mounted on an axis equal to the respective oblique angles 292,294 such that the outer surfaces thereof contact the support surfaces 268, 270 on contact areas that similarly extend along the oblique angles 292,294.

In a similar manner to that which is discussed above, both of the supporting surfaces 268 and 270 are wider than the respective support wheels 264 and 266 to account for tolerances and/or thermal expansion or contraction of the various components of assembly 210, as also discussed above in greater detail. In such an arrangement, oppositely-extending oblique angles 292 and 304 of the respective supporting surfaces 268,270 and the corresponding, inwardly-extending contact areas 296,298 allow the drawer body 214 to settle into a generally centered position between guide bodies 228,240 under the force of gravity. In this arrangement, thermal variations or tolerance stack-ups resulting in a drawer body 214 that is relatively wider than the distance 288 between guide bodies 222,240 to bet positioned vertically higher than in an instance with a drawer body 214 that is relatively narrower than the distance 288 between guide bodies 222,240. In this manner, a desired lateral positioning of drawer body 214 relative to guide bodies 222,240 and, accordingly, the interior 213 of refrigerator 212 can be maintained.

Figure 10:
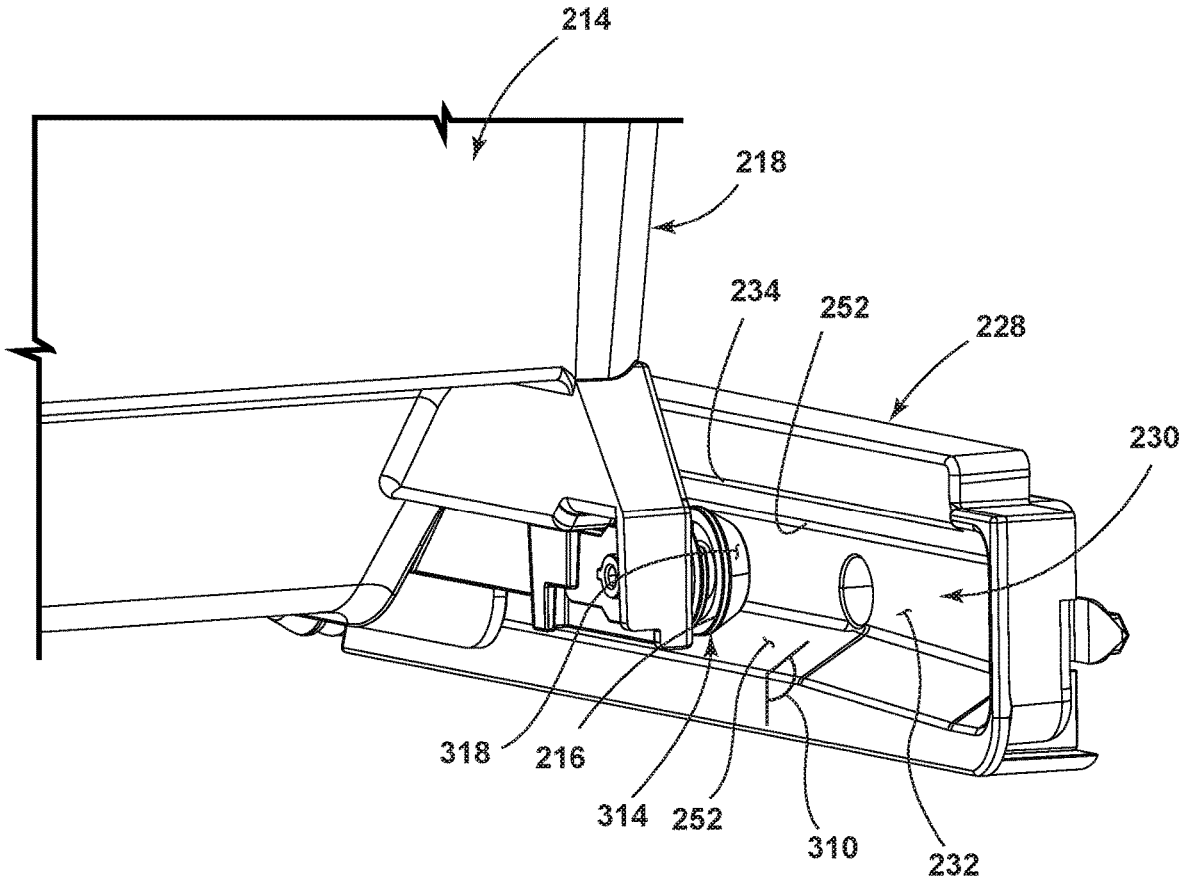
FIG. 10 is a further perspective detail view of another portion of the refrigerator drawer assembly.
Figure 11B:
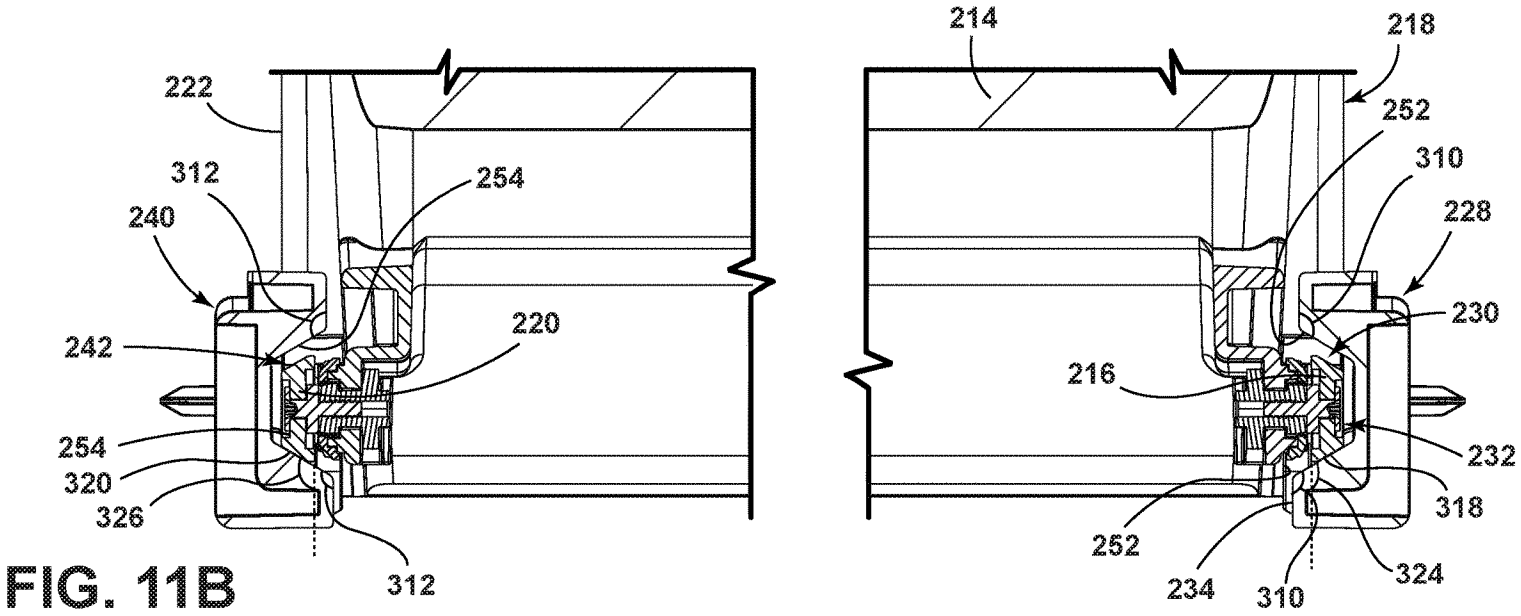

Similar to the other examples of assembly 10,110, discussed above, both the first and second guide bodies 228,240 can include respective tracks 230,242 that define respective track surfaces 252,254 extending between respective closed sides 232,244 and open sides 234,246. The tracks 230,242 can receive respective wheels 216,220 rotatably mounted on the first and second sides 218,222 of drawer body 214. As discussed above, the present track surfaces 252,254 can extend generally around the open sides 234,246 of the guide bodies 228,240 such that wheels 216,220 can alternately contact the track surfaces 252,254 on the upper or lower sides thereof to provide balancing support for drawer body 214 according to the position of drawer body 214 with respect to guide bodies 228,240 in sliding direction 250. As shown in FIGS. 10 and 11B, the surfaces 252,254 can be angled with respect to the open sides 234,236 (i.e. in a direction transverse to the sliding direction 250) at respective angles 310,312 in a similar manner to support surfaces 268,270. In particular, the track surfaces 252,254 can be angled such that the lower portions of the track surfaces 252,254 are generally parallel to and face the support surfaces 268,270.

In this arrangement, the assembly 210 can further include respective wheels 216,220 operably coupled with the drawer body 214,216 on the respective first and second sides 218,222 thereof. In this manner, the track surfaces 252,254 moveably support the respective wheels 216,220 on respective contact areas of the wheels 216,214 that extend along the angle 310,312 of the associated track surfaces 252,254. As shown, the contact areas of the wheels 216,200 are defined on respective outer surfaces 318,320 of the wheels 216,220 and defining angles 324,326 with respect to the radial direction of wheels 216,220 equal to the angle of the corresponding track surfaces 252,254. Similar to support wheels 264,266, the drawer body wheels 216,220 both define truncated conical shapes that taper in opposing parallel directions. The angles 310,312 of track surfaces 252, 254 can be generally equal to the oblique angles 292,294, such that all wheels 216,220,264,266 can be generally identical.

As discussed above, the wheels 216,220 may alternately contact the upper or lower portions of the track surfaces 252,254, depending on the position of drawer body 214 along the sliding direction 250. In this manner, the angles 310 and 312 of the track surfaces 252,254 are established relative to the adjacent outer portion of guide bodies 222,240 such that track surfaces 252, 254 are generally parallel with the closes portion of the outer surfaces 318,320 of the corresponding wheel 216,220 such that similar positioning in lateral direction 251 is achieved regardless of the side of track surfaces 252,254 contacted by wheels 216,218. Such an arrangement helps maintain drawer body 214 in a generally level position, regardless of the particular vertical position of drawer body 214 that results from the comparative widths of drawer body 214 and the spacing of guide bodies 222,240. The described configuration of track surfaces 252,254 and the corresponding wheels 216,220 can further help position drawer body 214 in the lateral direction 251 and can also help maintain drawer body 214 in a generally aligned position with respect to sliding direction 250, including by limiting any yaw of drawer body 214 relative to guide bodies 222,240 during movement of drawer body 214 in the sliding direction 250.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A refrigerator drawer assembly, comprising:

a drawer body;

a first wheel mounted on a first side of the drawer body;

a second wheel mounted on an opposite second side of the drawer body, the first and second wheels having respective widths;

a first guide body including a first track defining a closed side and an open side, the first guide body defining a lip surrounding at least a portion of the open side, the lip being spaced from the closed side at a first distance generally equal to the width of the first wheel, the first wheel being at least partially received between the closed side and the lip; and a second guide body including a second track defining closed side and an open side, the open side being spaced from the closed side at a second distance greater than the width of the second wheel.

2. The refrigerator drawer assembly of claim 1, wherein the first and second tracks extend in a sliding direction of the drawer body with respect to the first and second guide bodies, the first and second wheels being operably engaged with the first and second tracks, respectively, to facilitate movement of the drawer in the sliding direction.

3. The refrigerator drawer assembly of claim 1, wherein the first and second wheels are mounted with the drawer through the respective open sides of the first and second tracks.

4. The refrigerator drawer assembly of claim 1, wherein the second distance is greater than the width of the second wheel by between 120 and 200 percent.

5. The refrigerator drawer assembly of claim 1, wherein:

the first track includes a first track surface extending between the closed side of the first track and the lip of the first guide body;

the second track includes a second track surface extending between the closed side and the open side of the second track; and the first and second wheels are supported on the first and second track surfaces, respectively.

6. The refrigerator drawer assembly of claim 5, wherein:

the closed side of the first track defines a first interior surface extending from the first track surface;

the lip defines a second interior surface extending from the first supporting surface and facing the first interior surface; and the first wheel is at least partially received between the first interior surface of the closed side and the second interior surface of the lip.

7. The refrigerator drawer assembly of claim 1, wherein the drawer body defines first and second flanges extending along at least respective portions of the first and second sides of the drawer body; the assembly further including:

third and fourth wheels operably mounted on the first and second guide bodies, respectively, the third and fourth wheels operably supporting the drawer body on the first and second flanges, respectively.

8. A refrigerator drawer assembly, comprising:

a drawer body including a first side surface and a first flange extending laterally outwardly from the first side surface and defining a first support surface generally normal to the first side surface; and a first guide body including a first support wheel operably mounted on the first guide body, a first flexible cantilever arm extending from a portion of the first guide body, and a first guide wheel mounted on the cantilever arm, the first support surface of the drawer body being moveably supported with respect to the first guide body on the first support wheel, and the first guide wheel forcibly engaging the drawer body along the first side surface;

wherein the first guide wheel is sized and positioned on the first cantilever arm such that engagement between the first guide wheel and the drawer body causes deformation of the first cantilevered arm out of a natural position thereof, the deformation causing the first guide wheel to forcibly engage the drawer body along the first side surface.

9. The refrigerator drawer assembly of claim 8 wherein:

the first support wheel is rotatably mounted on the first guide body about a first axis;

the first guide wheel is rotatably mounted on the first cantilever arm about a second axis extending generally perpendicular to the first axis; and the first and second axes define respective planes arranged generally perpendicular to each other.

10. The refrigerator drawer assembly of claim 8, wherein the drawer body further includes a second side surface opposite the first side surface and a second flange extending laterally outwardly from the second side surface and defining a second support surface generally normal to the second side surface, the refrigerator drawer assembly further comprising:

a second guide body including a second support wheel operably mounted on the second guide body, the second support surface of the drawer body being moveably supported with respect to the second guide body on the second supporting wheel.

11. The refrigerator drawer assembly of claim 10, wherein:

the second guide body further includes a second resiliently flexible cantilever arm extending from a portion of the second guide body, and a second guide wheel mounted on the second cantilever arm; and the second guide wheel forcibly engages the drawer body along the second side surface.

12. The refrigerator drawer assembly of claim 11, wherein the first guide wheel and the second guide wheel forcibly engage the drawer body in opposite directions to reduce lateral movement of the drawer body on the first and second support wheels.

13. The refrigerator drawer assembly of claim 8, wherein:

the drawer body further includes a first track wheel operably mounted on the first side surface thereof in a position adjacent the first flange; and the first guide body further includes a first track extending parallel with the first cantilever arm in a direction away therefrom, the second supporting wheel being operably received on the first track.

14. A refrigerator drawer assembly, comprising:

a drawer body including a first side surface with a first flange extending laterally outwardly from the first side surface and defining a first support surface at a first oblique angle with respect to the first side surface and a second side surface with a second flange extending laterally outwardly from the second side surface and defining a second support surface at a second oblique angle with respect to the second side surface;

a first guide body including a first support wheel operably mounted on the first guide body, the first support surface of the drawer body being moveably supported with respect to the first guide body on the first support wheel along a contact area of the first support wheel that extends along the first oblique angle; and a second guide body including a second support wheel operably mounted on the second guide body, the second support surface of the drawer body being moveably supported with respect to the second guide body on the second support wheel along a contact area of the second support wheel that extends along the second oblique angle.

15. The refrigerator drawer assembly of claim 14, wherein the first and second support wheels both define truncated conical shapes.

16. The refrigerator drawer assembly of claim 15, wherein the respective contact areas of the first and second support wheels are defined on outer surfaces of the respective first and second support wheels that intersect axes of the first and second support wheels at respective angles equal to the first and second oblique angles.

17. The refrigerator drawer assembly of claim 14, wherein the first guide body defines a first track portion extending along the first guide body in a sliding direction of the drawer body away from the first support wheel, the first track portion defining a first track surface angled in a direction transverse to the sliding direction at an angle generally parallel with first oblique angle, at least along a portion of the first track surface, the assembly further comprising:

a first track wheel operably coupled with the drawer body, the first track surface moveably supporting the first track wheel on a contact area of the first track wheel that extends along the angle of the first track surface.

18. The refrigerator drawer assembly of claim 17, wherein the contact area of the first track wheel is defined on an outer surface of the first track wheel that is angled with respect to a radial direction of the first track wheel at an angle equal to the angle of the first track surface.

19. The refrigerator drawer assembly of claim 17, wherein the first support wheel and the first track wheel both define truncated conical shapes that taper in opposing parallel directions.

* * * * *